US005405650A

United States Patent [19]

Boulanger et al.

[11] Patent Number: 5,405,650

[45] Date of Patent: Apr. 11, 1995

[54] METHOD FOR MANUFACTURING A NON-WOVEN FABRIC MARKED WITH A PRINT

[75] Inventors: Roger Boulanger, Ste-Julie; Flavio Metta, Longueuil; Real Contant, Repentigny, all of Canada

[73] Assignee: Johnson & Johnson Inc., Canada

[21] Appl. No.: 264,221

[22] Filed: Jun. 22, 1994

Related U.S. Application Data

[63] Continuation of Ser. No. 42,376, Apr. 2, 1993, abandoned.

[30] Foreign Application Priority Data

Apr. 3, 1992 [CA] Canada ..... 2065120

[51] Int. Cl.[6] ..... B05D 1/36

[52] U.S. Cl. ..... 427/261; 28/104; 28/112; 28/167; 28/169; 101/491; 156/181; 427/389.9; 427/412; 427/424; 427/428; 427/434.6

[58] Field of Search ..... 427/210, 211, 261, 288, 427/389.9, 412, 424, 428, 434.6; 28/104, 112, 167, 169; 156/181; 101/491

[56] References Cited

U.S. PATENT DOCUMENTS

| | | | |
|---|---|---|---|
| 1,742,516 | 4/1922 | Mills | 101/491 |
| 2,019,845 | 11/1935 | Colbert et al. | 32/33 |
| 2,705,688 | 4/1955 | Ness et al. | 117/44 |
| 3,274,018 | 9/1966 | Russell et al. | 427/288 |
| 3,908,058 | 9/1975 | Russell et al. | 427/288 |
| 4,135,024 | 1/1979 | Callahan et al. | 427/288 |
| 4,668,540 | 5/1987 | Long et al. | 427/412 |
| 4,931,355 | 6/1990 | Radwanski et al. | 28/104 |
| 4,961,964 | 10/1990 | Dahlgren | 427/211 |
| 5,238,644 | 8/1993 | Boulanger et al. | 28/104 |

FOREIGN PATENT DOCUMENTS

| | | | |
|---|---|---|---|
| 1143929 | 4/1983 | Canada . | |
| 72691 | 2/1983 | European Pat. Off. | D04H 1/48 |
| 84963 | 8/1983 | European Pat. Off. | D04H 1/44 |
| 351949 | 1/1990 | European Pat. Off. | D04H 1/44 |
| 473325 | 2/1992 | European Pat. Off. | D04H 1/44 |
| 59-66554 | 4/1984 | Japan | 28/104 |
| 62-62175 | 12/1987 | Japan | 156/181 |

*Primary Examiner*—Bernard Pianalto

[57] ABSTRACT

A method for manufacturing a non-woven fabric printed with a decorative pattern. A fibrous starting material whose individual fibers are capable of movement relatively to one another under the influence of applied fluid forces is subjected to a fluid stream for entangling the fibers to form a unitary fibrous network. The unitary fibrous network is impregnated with liquid binder which solidifies and consolidates the non-woven fabric. Before the binder has cured and is still in a liquid condition, the unitary fibrous network is printed with a decorative pattern. Subsequently, the unitary fibrous network is dried to simultaneously cure the binder and the colorant forming the decorative pattern.

16 Claims, 3 Drawing Sheets

METHOD FOR MANUFACTURING A NON-WOVEN FABRIC MARKED WITH A PRINT

This is a continuation of application Ser. No. 08/042,376, filed Apr. 2, 1993, abandoned.

FIELD OF THE INVENTION

The invention relates to the art of manufacturing fibrous materials and, more particularly, to a novel method and an apparatus for manufacturing a non-woven fabric marked with a print.

BACKGROUND OF THE INVENTION

Non-woven fabrics are well-suited for applications which require a low cost fibrous web. Examples are disposable polishing or washing cloths.

Non-woven fabrics are normally produced from a web of loosely associated fibers that are subjected to a fiber rearranging method to entangle and mechanically interlock the fibers into a unitary reticular network. The fiber rearrangement is achieved under the effect of fluid forces applied to the fibers through a fluid permeable, web confining and supporting structure comprising a rigid apertured member with a predetermined pattern of fluid passages, and a flexible foraminous sheet disposed in a face-to-face relationship to the apertured member.

In one form of construction, the rigid apertured member is a rotating hollow drum and the flexible foraminous sheet is an endless screen belt in overlapping relationship with the hollow drum and advancing therewith. The web of loosely associated fibers which forms the starting material of the non-woven fabric production method is confined between the drum and the screen belt and is advanced through a fluid stream creating the entangling forces acting to entangle the fibers.

The so-called "Rosebud" non-woven fabric production method requires that the source of the fluid stream be located outside the hollow drum, the fluid particles impinging on the fibers through the screen belt. In operation, the fibers are drawn by the fluid mass flowing out of the apertured hollow drum, into the fluid passages thereof, and they are mechanically interlocked and entangled in protuberant packings which are interconnected by flat fiber bundles extending over the land areas of the drum. The resulting non-woven fabric has a three-dimensional structure presenting a knobby side containing the apexes of the fiber packings, and a flat and smoother side containing the base portions of the fiber packings and the interconnecting bundles.

In a variant of the Rosebud method, known as the "Keyback" method, the direction of the fluid stream is reversed, whereby the fluid particles reach the fibers by passing through the fluid passages on the drum. In contrast to the Rosebud method, the fibers are packed together on the land areas of the drum forming a network with clear holes arranged into a pattern corresponding to the pattern of fluid passages on the hollow drum.

Canadian patent 1,143,929 issued to Johnson & Johnson, U.S.A. on Apr. 5, 1983 discusses in detail a method for manufacturing a non-woven fabric by fluid entanglement and constitutes a reference of interest to the present subject.

For a wide range of applications, non-woven fabrics having superior resistance characteristics are required. To achieve this objective, it is known from the prior art to apply a binder substance to the non-woven fabric in order to consolidate the fibrous network. The binder substance, when cured, establishes bonds between adjacent fibers and prevents them to move one relatively to the other. Accordingly, the tenacity of the non-woven fabric increases by virtue of a reduction in inter-fiber displacement when destructive forces act on the non-woven fabric.

For enhancing the aesthetical appearance of a non-woven fabric, it is common practice to print the non-woven fabric with a decorative pattern. Typically, this operation is carried out at a printing station after the binder has been heat-cured. The printing station operates according to the principle of a common printing press. More specifically, it comprises a printing roll which is engraved to form a colorant transfer surface applying colorant, such as ink, according to a desired pattern on the surface of the non-woven fabric.

A drawback of traditional methods for manufacturing a non-woven fabric marked with a print, resides in the necessity to provide an additional drying station on the production line to dry the print before the non-woven fabric can be handled for further processing. Accordingly, the non-woven fabric is subjected in the overall to two successive drying operations, one for curing the binder and the other one for drying the print, which increase the complexity of the production equipment and the manufacturing cost of the final product.

SUMMARY OF THE INVENTION

An object of the present invention is a method for manufacturing a binder consolidated, non-woven fabric marked with a print, which does not require to separately dry the binder and the colorant applied to the non-woven fabric.

Another object of the invention is a novel apparatus for carrying out the aforementioned method.

As embodied and broadly described herein, the invention provides a method for manufacturing a non-woven fabric, comprising the following consecutive steps:

- providing a fibrous starting material whose individual fibers are capable of movement relatively to one another under the influence of applied fluid forces;
- subjecting the fibrous starting material to a fluid stream for entangling the fibers to form a unitary fibrous network;
- applying liquid binder to the unitary fibrous network, when cured the binder being converted to a substantially solid state for consolidating the unitary fibrous network;
- applying liquid colorant to the unitary fibrous network while the binder is in a liquid and substantially uncured condition; and
- curing the binder and the colorant to consolidate the unitary fibrous network and to fix the colorant thereto.

In a preferred embodiment, the colorant is applied to selected areas of the unitary fibrous network to create a decorative pattern. The viscosity of the colorant is selected to prevent the pattern from blurring when the colorant contacts binder in the unitary fibrous network in a liquid and uncured condition (for the purpose of this specification, a substance will be considered as being a liquid as long as its viscosity does not exceed 4000 centipoises (cps). Advantageously, the viscosity of the colorant is no less than 100 cps. More preferably, the viscosity of the colorant is in the range from about 200 cps to about 1500 cps. Most preferably, the viscosity of the colorant is in the range from about 400 cps to about 1000 cps.

The application of colorant on a substrate containing liquid binder is contrary to the conventional line of thought which dictates that a fibrous substrate is suitable for printing only when it is dry to prevent the colorant mark from blurring. The present invention is a departure from this traditional view and achieves surprising results in terms of an overall simplification of the manufacturing process of the non-woven fabric.

As embodied and broadly described herein, the invention also provides an apparatus for manufacturing a non-woven fabric from a fibrous starting material whose individual fibers are capable of movement under the influence of applied fluid forces, the apparatus comprising:

means to generate a fluid stream applied to the starting material for entangling the fibers to form a unitary fibrous network;

means for applying liquid binder to the unitary fibrous network, when cured the binder being converted to a substantially solid state for consolidating the unitary fibrous network;

means for applying liquid colorant to the unitary fibrous network while the binder is in a liquid and substantially uncured condition; and means for curing the binder and the colorant to consolidate the unitary fibrous network and to fix the colorant thereto.

In a preferred embodiment, the binder application is a post fiber entangling operation carried out at a binder applicator station where the freshly formed fibrous web is coated or sprayed with binder. It is also possible to apply the binder to the fibrous web in a foamed condition or to immerse the web in a binder bath. Irrespective of the technique chosen, the binder is applied at a rate such as to fully impregnate the fibrous web to promote cohesion throughout the entire fibrous volume.

Preferably, the application of colorant to the fibrous web is carried out by means of a printing roll having a recessed area forming a colorant transfer surface. A film of colorant is applied to the colorant transfer surface which carries the film to the fibrous web to print a certain pattern thereon.

Preferably, the binder and the colorant are cured simultaneously by passing the web in contact with a plurality of drying cylinders which are heated by steam, electrical resistance, induction or other methods. The drying cylinders may be arranged in a pair of spaced apart rows, the non-woven web being trained over the drying cylinders in a serpentine path.

DESCRIPTION OF A PREFERRED EMBODIMENT

Figure 1:
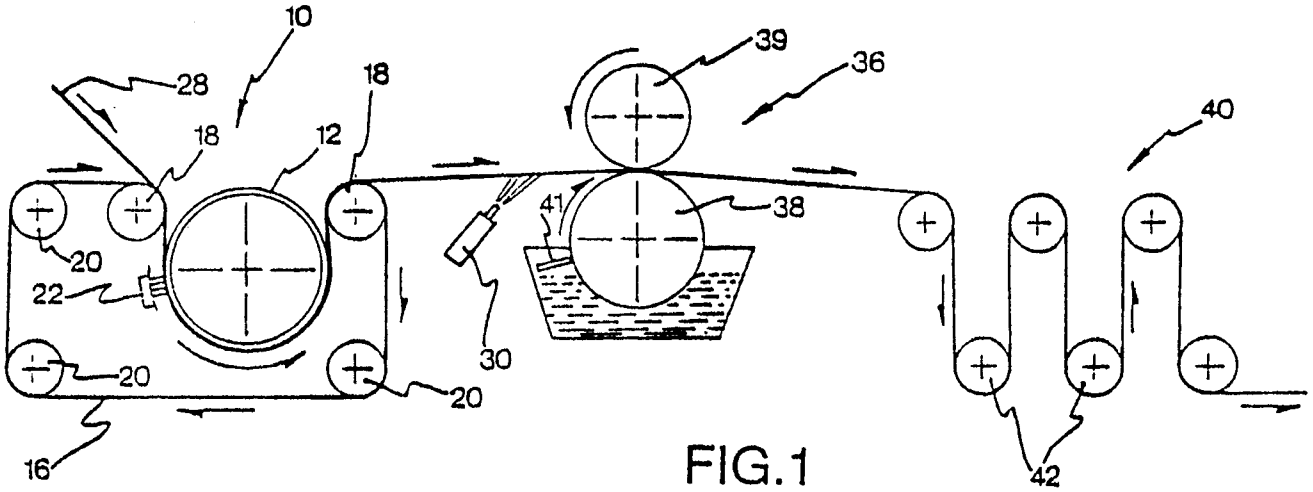
FIG. 1 is a schematical view of an apparatus for producing a non-woven fabric in accordance with the present invention.
Figure 2:
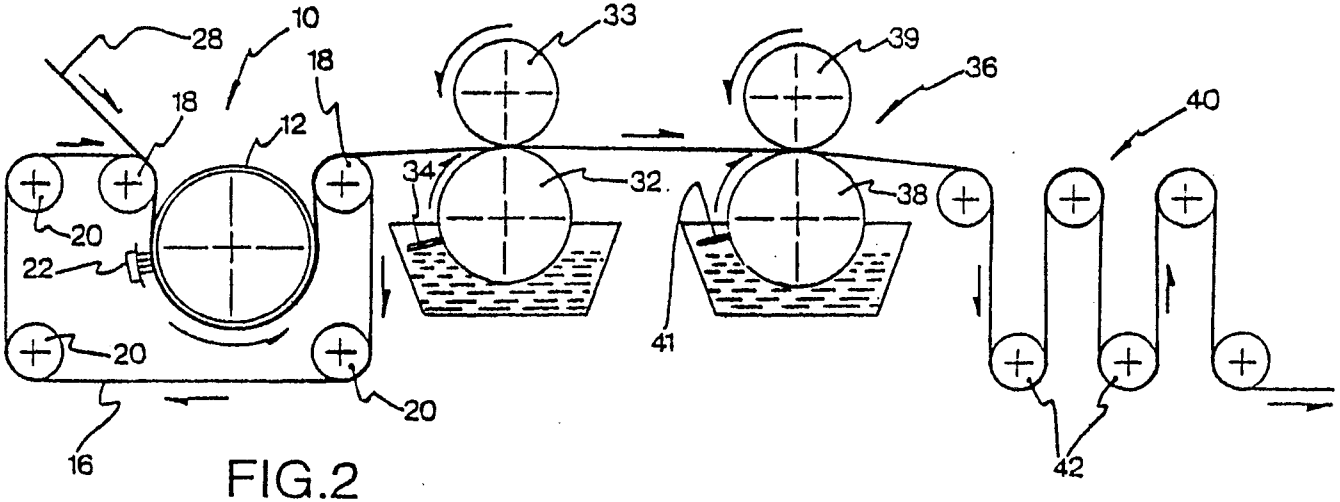
FIG. 2 is a schematical view of an apparatus for producing a non-woven fabric in accordance with a variant.
Figure 3:
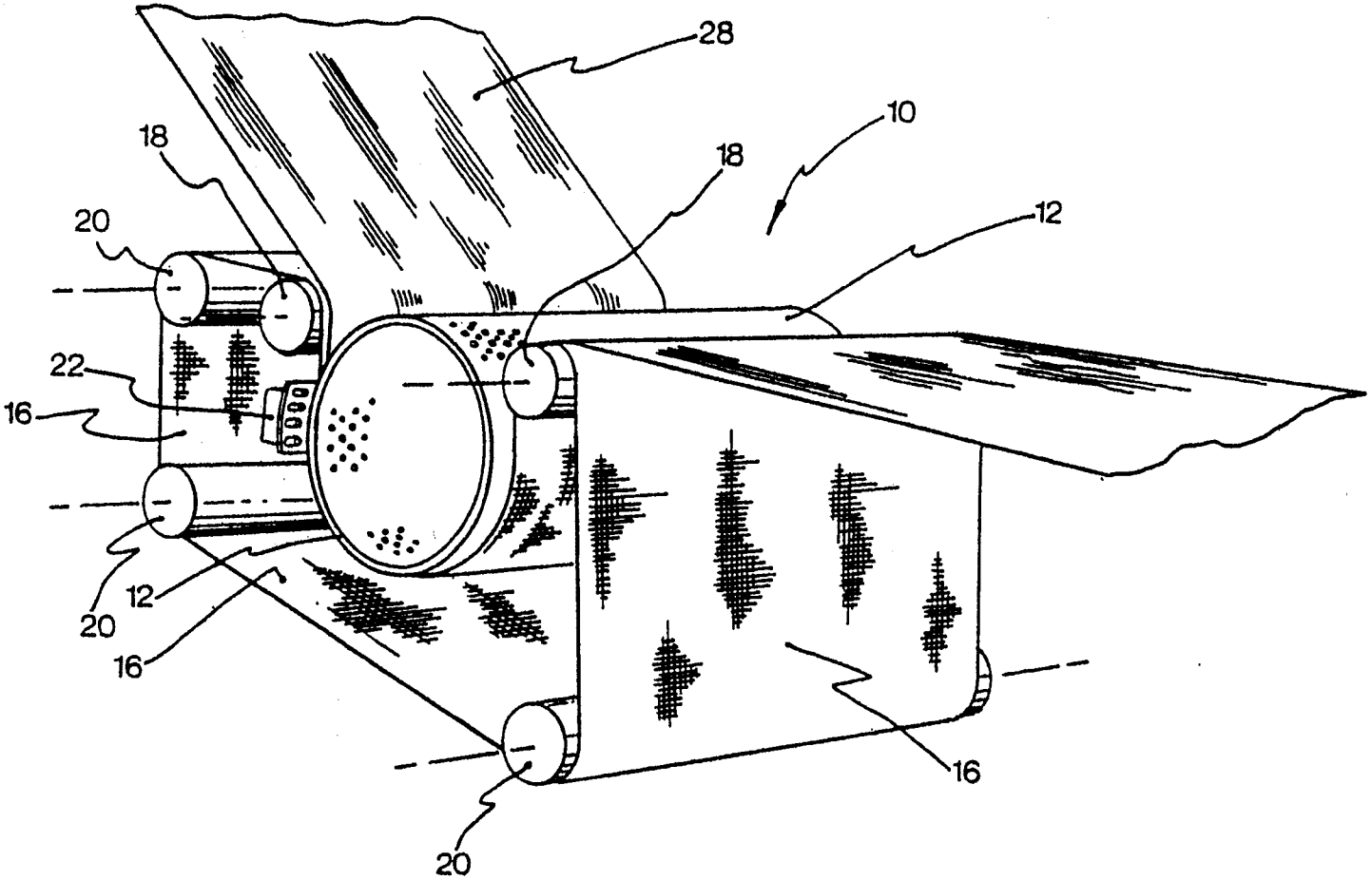
FIG. 3 is an enlarged isometric view of a fiber entangling station of the apparatus shown in FIGS. 1 and 2.
Figure 4:
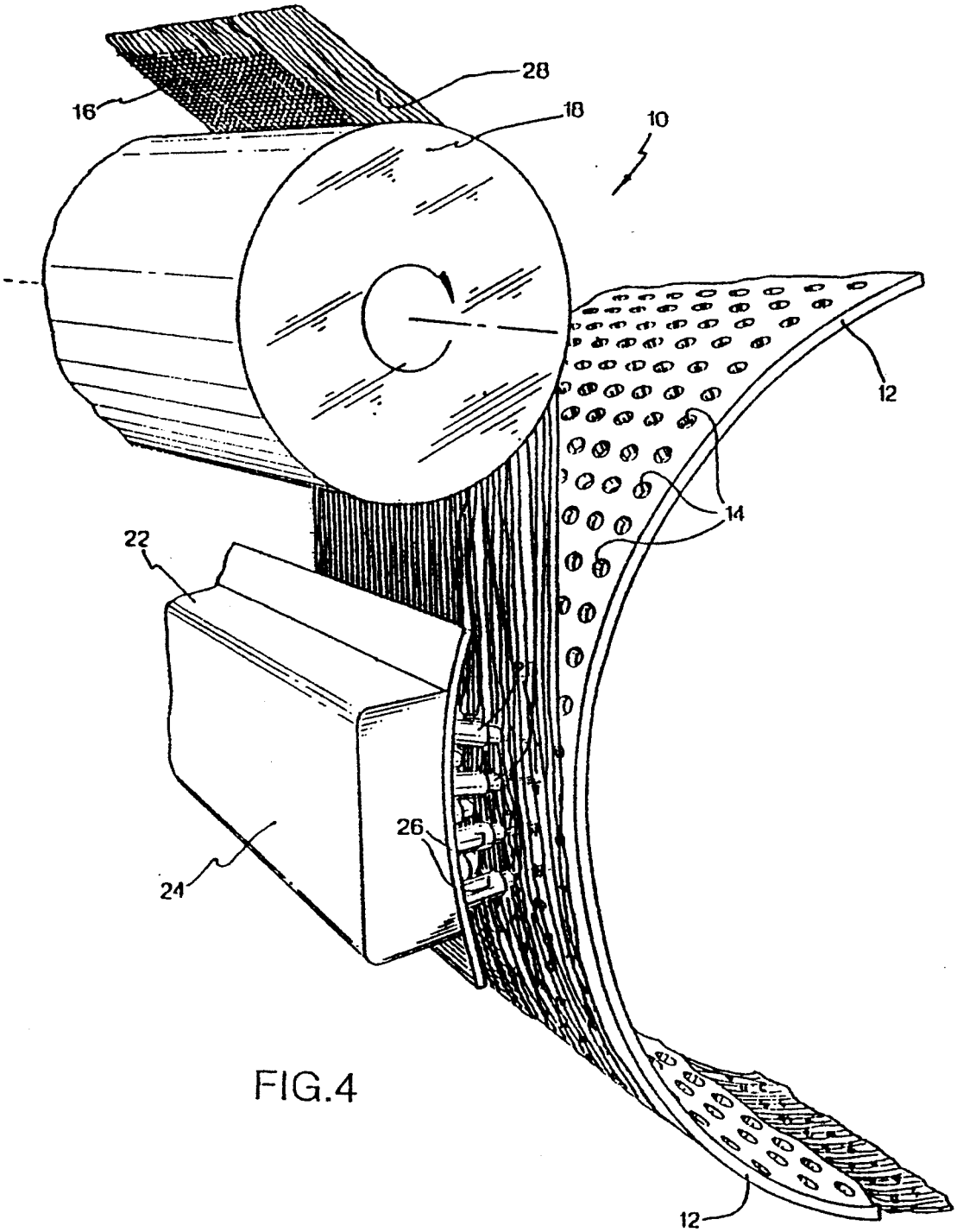
FIG. 4 is a further enlarged fragmentary isometric view of the fiber entangling station of FIG. 3, showing with more detail the structure of a perforated hollow drum and of a screen belt for holding and advancing fibrous starting material through fluid streams.

FIGS. 1 and 2 illustrate an apparatus constructed in accordance with the invention, for manufacturing a non-woven fabric by the application of fluid forces to a web of starting material in which the individual fibers are loosely associated and are free to move one relatively to the other. The apparatus comprises a fiber entangling station, best shown in FIGS. 3 and 4 and identified comprehensively by the reference numeral 10. The fiber entangling station 10 comprises a hollow metallic drum 12 mounted for rotation about its longitudinal axis into a suitable cradle (not shown). A drive mechanism (not shown) is provided to rotate the drum 12 in a counter-clockwise direction at a controlled speed. The drive mechanism is of a well-known construction and does not form part of this invention.

The shell of the drum 12 is provided on its entire surface with openings 14 arranged into a predetermined pattern. The pattern of the openings 14 is an important factor which determines, in conjunction with other factors, the network structure of the non-woven fabric. In the art of manufacturing non-woven fabrics, the effect of the openings scheme on the non-woven fabric structure is well understood by those skilled in the art and it is not deemed necessary here to discuss this matter in detail.

The fiber entangling station 10 also comprises an endless screen belt 16 which is mounted in a partially overlapping relationship to the drum 12 by means of guide rollers 18. Support rollers 20 are positioned at the corners of an imaginary rectangle and act, in conjunction with the guide rollers 18, to tension and establish a path of travel for the screen belt 16. One or more of the rollers 18 or 20 are drive rollers for advancing the belt 16 in unison with the drum 12.

The structure of the screen belt 16 is another factor influencing the network structure of the non-woven fabric, as it is known to those skilled in the art. Therefore, the screen belt must be selected in accordance with all the other operating conditions of the machine, such as the type of drum which is being used, the type of fibers to be processed, the desired non-woven fabric structure and surface finish, among others.

A manifold 22, mounted outside the hollow drum 12, creates fluid streams for entangling the loosely associated fibers confined between the drum 12 and the screen belt 16 into a unitary, thin reticular network. The manifold 22 includes a hollow metallic box 24 supporting a series of water jets or nozzles 26 in fluid communication with the interior of the box 24 so as to create a plurality of fluid streams impinging on the screen belt 16.

Although not shown in the drawings, it is to be understood that the manifold 22 is connected to a source of pressurized fluid, preferably water, for producing the fluid streams.

In a variant, not shown in the drawings, the manifold 22 may be located inside the hollow drum, whereby the fluid streams produced by the nozzles 26 are directed radially outwardly. As it is well-known and understood by those skilled in the art, this embodiment would achieve a different fibrous network structure than the apparatus illustrated in FIGS. 1 to 4.

The number of nozzles 26 is a function of the amount of energy per period of time or power, that must be supplied by the fluid streams to rearrange the fibers of the web into the desired network structure. The type of fibers used, the speed of the web through the fluid streams, among other factors, determine the power requirement of the apparatus.

A web 28 of starting material, containing loosely associated fibers, thus capable of movement one relative to the other, is supplied in a continuous sheet form from a supply station (not shown) and is deposited over the horizontally extending forward run of the screen belt 16 preceding the section of the screen belt which loops the hollow drum 12. The web 28 is pulled between the hollow drum 12 and the screen belt 16, which form in combination a fluid permeable web confining and supporting structure, guiding and advancing the web 28 through the water streams produced by the manifold 22, applying fluid forces to the web fibers to entangle them and form a unitary fibrous network.

As best shown in FIGS. 1 and 2, downstream the fiber rearranging station 10, the apparatus according to the invention comprises a binder applicator station which applies a solution of binder to the non-woven web. The binder, when cured, solidifies and consolidates the non-woven web, increasing its resistance. Binders are commercially available compounds and the selection of a particular binder depends upon the desired characteristics of the final product. The following binders have been found satisfactory:

vinyl ethylene;
vinyl chloride;
vinyl acetate;
vinyl acrylite
polyvinyl alcohol;
polyvinyl acetate;
carboxylated polystyrene;
rubber polyethylene;
polyacrylonitrile; and
mixtures thereof.

The binder applicator station may take several forms. As shown in FIG. 1, the binder may be sprayed directly onto the non-woven web by a nozzle 30 in fluid communication with a supply of liquid binder under pressure (not shown in the drawings). The spray nozzle 30 is adjusted to achieve the desired binder application pattern. In most cases, it will be such as to apply the binder uniformly over the non-woven web.

In a variant shown in FIG. 2, the binder applicator station comprises a smooth-surfaced coating roll 32 having a lower end immersed in a binder bath. A back-up roll 33 is provided above the roll 32 to define therewith a nip through which the non-woven web passes. The surface of the coating roll 32 is preferably treated to have an affinity for the binder so as to carry, as the roll 32 rotates, a thin film of binder and deposit same on the non-woven web through rolling contact therewith. A scraper blade 34 is provided to control the thickness of the binder film adhering to the surface of the coating roll 32.

A smooth-surfaced coating roll 32 will achieve a uniform binder deposition. If it is desired to apply the binder according to a certain pattern, a coating roll having a relief surface is required, the recessed areas of the relief surface constituting the binder transfer surfaces.

Other binder application methods are possible. For example, the non-woven web may be passed through a binder bath where it is directly immersed in the binder solution. This embodiment is suitable for applications where a low cost, uncomplicated method to treat the web with binder is required. It may also be envisaged to deposit the binder in a foamed condition on the non-woven web, which is then caused to penetrate in the web such as by the application of vacuum. A binder solution can be foamed by providing therein an effective amount of surfactant and by mechanically agitating and aerating the solution.

When the binder is applied uniformly on the non-woven web by spraying, coating or foaming, the binder flow rate is selected to saturate the non-woven web for promoting cohesion throughout the entire fibrous volume.

It may be envisaged to add to the binder colour pigments for colouring the non-woven web at the areas which are treated with binder. When the binder cures, it consolidates the non-woven web and also fixes the colour pigments to the fibrous matrix and prevents them from chipping away under vigorous agitation.

Further downstream of the fiber rearranging station 10, the apparatus for manufacturing the non-woven fabric is provided with a printing station 36 for printing a decorative pattern on the non-woven web. Basically, the printing station 36 operates according to the principle of a printing press using an inked relief surface to impress a mark on the non-woven web in accordance with a predetermined pattern. More particularly, the printing station 36 comprises a printing roll 38 whose peripheral surface includes a recessed area corresponding to the mark to be printed. The bottom portion of the roll is immersed into an ink bath and as the roll rotates an ink coating adheres to its surface. A scraper blade 41 is provided to remove the ink from the roll 38 except on the recessed area which carries the remaining shaped ink coating to the non-woven web. A back-up roll 39 is provided above the inked roll 38 to support the non-woven web during the printing operation.

The ink used for the printing operation comprises colour pigments suspended in binder. The binder fulfils a dual role, namely it acts as a vehicle for applying the colour pigments to the non-woven web and it serves to fix the colour pigments to the fibrous matrix when it is cured.

The following ink formulation has been found satisfactory:

| INGREDIENTS | PERCENTAGE BY WEIGHT IN THE INK SOLUTION |
|---|---|
| Water | 63.62% |
| Thickener solution[1] | 8.00% |
| Colour pigments solution[2] | 1.50% |
| Binder solution[3] | 25.00% |
| Catalyst solution[4] | 1.00% |
| Resin solution[5] | 0.504 |
| Wetting agent solution[6] | 0.30% |
| Anti-foaming agent solution[7] | 0.08% |

1. The thickener solution is provided for controlling the ink viscosity. A thickener solution at 14% solids by weight manufactured by NACAN PRODUCTS COMPANY and commercialized under the name ALCOGUM 5544 has been found satisfactory.
2. A blue colour pigments solution at 40.0% solids by weight manufactured by HOECHST CANADA INC. and commercialized under the name COLANIL A2R100 has been found satisfactory.
3. A binder solution at 45.5% solids by weight manufactured by ROHM AND HAAS CANADA INC.

and commercialized under the name HA8J has been found satisfactory.

4. The catalyst solution is provided to accelerate the curing of the binder in the ink. A catalyst solution at 33.1% solids by weight, manufactured by CYANAMID CANADA INC. and commercialized under the name AEROTEX ACCELERATOR 187 has been found satisfactory.
5. The resin solution is provided to enhance the adhesion of the colour pigments to the fibrous matrix to which the ink is applied. A resin solution at 80% solids by weight manufactured by CYANAMID CANADA INC. and commercialized under the name CYREZ 933 has been found satisfactory.
6. The wetting agent solution is provided to prevent the ink, when cured on the fibrous substrate to become hydrophobic. This is particularly advantageous when the non-woven web which is being printed is intended to be used as a fluid-absorbent or wiping cloth. For such applications, it is highly desirable to avoid the formation of hydrophobic zones which may degrade the fluid absorbency of the fabric. A wetting agent solution at 60% solids by weight manufactured by ROHM AND HAAS CANADA INC. and commercialized under the name TRITON GR-5M has been found satisfactory.
7. The anti-foaming agent solution is provided to prevent the ink from forming under vigourous agitation. An anti-foaming agent solution at 15% solids by weight manufactured by GENERAL ELECTRIC COMPANY and commercialized under the name ANTI-FOAM 60 has been found satisfactory.

Instead of ink, other colorants may be used, such as dyes, for example.

The printing of the non-woven web is carried out immediately after the binder has been applied. As a result, the inked impression is made on the non-woven web before the binder has cured and it is, therefore, in a liquid state. Surprisingly, it has been found that a high definition print can be obtained, substantially without blurring although the ink is deposited on a wet web. A factor which influences the ability of the ink mark to resist flowing out is the degree of fluidity of the ink. For optimum results, the viscosity of the ink should be no less than 100 cps, more preferably in the range from about 200 cps to about 1500 cps and most preferably in the range from about 400 cps to about 1000 cps. As mentioned previously, the viscosity of the ink is controlled by varying the amount of thickener added to the ink solution.

After the printing operation has been completed, the non-woven web is dried to simultaneously cure the binder applied to consolidate the non-woven web and the ink. The drying station, designated comprehensively by the reference numeral 40, comprises a series of heated cylinders 42 arranged in two vertically spaced apart rows. The cylinders 42 may be heated by steam, induction or electrical resistive elements, among others. The non-woven web is trained in a serpentine path over the heated cylinders 42.

The scope of the present invention is not limited by the description, examples and suggestive uses herein, as modifications can be made without departing from the spirit of the invention. Thus, it is intended that the present application covers the modifications and variations of this invention provided that they come within the scope of the appended claims and their equivalents.

We claim:

1. A method for manufacturing a non-woven fabric, comprising the following consecutive steps:

providing a fibrous starting material whose individual fibers are capable of movement relatively to one another under the influence of applied fluid forces;

subjecting said fibrous starting material to a fluid stream for entangling said fibers to form a unitary fibrous network;

applying liquid binder to said unitary fibrous network, when cured said binder being converted to a substantially solid state for consolidating said unitary fibrous network;

applying liquid colorant to said unitary fibrous network subsequent to the application of liquid binder, said liquid colorant being applied while said binder is in a liquid and substantially uncured condition, wherein said colorant has a viscosity selected to prevent a mark created by said colorant from blurring when said colorant contacts said binder; and curing said binder and said colorant to consolidate said unitary fibrous network and to fix said colorant thereto.

2. A method as defined in claim 1, wherein said binder is applied uniformly to said unitary fibrous network.

3. A method as defined in claim 2, further comprising the step of providing a colouring agent in said binder to uniformly colour said unitary fibrous network.

4. A method as defined in claim 1, wherein said liquid binder impregnates said unitary fibrous network with binder.

5. A method as defined in claim 1, wherein said colorant is applied to selected areas of said fibrous network to create a decorative pattern.

6. A method as defined in claim 1, wherein the step of applying liquid binder to said unitary fibrous network is selected from the group consisting of:

spraying said unitary fibrous network with binder;

coating said unitary fibrous network with binder through contact with a binder carrier surface;

immersing said unitary fibrous network in binder; and depositing binder in a foamed condition on said unitary fibrous network and causing said binder to penetrate therein.

7. A method as defined in claim 1, wherein said binder is selected from the group consisting of vinyl ethylene, vinyl chloride, vinyl acetate, vinyl acrylite, polyvinyl alcohol, polyvinyl acetate, carboxylated polystyrene, rubber polyethylene, polyacrylonitrile and mixtures thereof.

8. A method as defined in claim 1, wherein said colorant contains a wetting agent to prevent said colorant from becoming hydrophobic when cured.

9. A method as defined in claim 1, wherein said colorant has a viscosity substantially no less than 100 cps.

10. A method as defined in claim 1, wherein said colorant has a viscosity in the range from about 200 cps to about 1500 cps.

11. A method as defined in claim 1, wherein said colorant has a viscosity in the range from about 400 cps to about 1000 cps.

12. A method as defined in claim 1, wherein the step of depositing colorant on said unitary fibrous network consists of contacting said unitary fibrous network with a colorant coated surface.

13. A method as defined in claim 1, wherein the step of curing said binder and said colorant consists of heating said unitary fibrous network.

14. A method as defined in claim 13, wherein the step of curing said binder and said colorant consists of passing said unitary fibrous network in contact with a heated surface.

15. A method as defined in claim 1, wherein the step of applying colorant to said unitary fibrous network consists of applying colorant to a recessed area of a relief surface and contacting said unitary fibrous network with said relief surface to create a mark on said unitary fibrous network corresponding to said recessed area.

16. A method as defined in claim 1, wherein said colorant contains binder and colour pigments, when said colorant is cured said binder fixing said colour pigments to said unitary fibrous network.

* * * * *